US011674458B1

(12) United States Patent
Ma

(10) Patent No.: US 11,674,458 B1
(45) Date of Patent: Jun. 13, 2023

(54) ELECTRONIC THROTTLE BODY WITH IMPROVED STRUCTURE

(71) Applicant: Guangdong Huakong Auto Tech Co., Ltd., Dongguan (CN)

(72) Inventor: Hongjun Ma, Dongguan (CN)

(73) Assignee: GUANGDONG HUAKONG AUTO TECH CO., LTD., Dongguan (CN)

( * ) Notice: Subject to any disclaimer, the term of this patent is extended or adjusted under 35 U.S.C. 154(b) by 0 days.

(21) Appl. No.: 17/887,483

(22) Filed: Aug. 14, 2022

(30) Foreign Application Priority Data

May 5, 2022 (CN) ..... 202221061260.6

(51) Int. Cl.
*F02D 9/00* (2006.01)
*F02D 9/10* (2006.01)

(52) U.S. Cl.
CPC ..... *F02D 9/109* (2013.01); *F02D 9/1065* (2013.01)

(58) Field of Classification Search
CPC ..... F02D 9/109; F02D 9/1065
See application file for complete search history.

(56) References Cited

U.S. PATENT DOCUMENTS 2,034,430 A * 3/1936 Farrow ..... F02M 29/00 261/50.1
3,539,157 A * 11/1970 Fort ..... F02M 7/106 137/806
4,709,581 A * 12/1987 Nishimura ..... G01F 1/6842 73/202
6,523,522 B1 * 2/2003 Costin ..... F02D 35/0007 123/399
7,090,203 B2 * 8/2006 Goto ..... F02M 19/10 261/118
10,054,062 B1 * 8/2018 Andrasko ..... F02D 9/105
10,961,968 B2 * 3/2021 Farrell ..... F02M 63/0056
11,136,924 B1 * 10/2021 Koo ..... F02D 9/104
11,493,010 B2 * 11/2022 Whittle ..... F02M 69/04
2006/0244158 A1 * 11/2006 Grant ..... F02M 11/02 261/41.3
2007/0074452 A1 * 4/2007 Yates ..... F02M 21/047 261/DIG. 12
2008/0237517 A1 * 10/2008 Krupadanam ..... F02D 11/10 251/129.01

(Continued)

*Primary Examiner* — Jacob M Amick
*Assistant Examiner* — Sherman D Manley
(74) *Attorney, Agent, or Firm* — Bayramoglu Law Offices LLC

(57) ABSTRACT

An electronic throttle body with an improved structure includes a throttle body. A plurality of vertically through airflow channels are provided on the throttle body, and a butterfly valve controlling a vent flow and a fuel atomizing ring configured to atomize fuel are arranged in each airflow channel. Centers of one or more butterfly valves are connected in series through rotating shafts to implement linked flipping, the rotating shafts are arranged parallel to each other, a drive gear is fixedly mounted to one end of each rotating shaft extending out of the throttle body coaxially, and the rotating shafts rotate synchronously through a servo driving apparatus. The servo driving apparatus and electrically controlled sprays respond synchronously, thereby improving the combustion efficiency of fuel in an engine. When the engine is idle, butterfly valves are directly driven through the servo driving apparatus to accurately control an air inflow of the engine.

6 Claims, 3 Drawing Sheets

(56) References Cited

U.S. PATENT DOCUMENTS

| | | | | |
|---|---|---|---|---|
| 2015/0108256 | A1* | 4/2015 | Flynn | F02D 9/1035 239/562 |
| 2018/0119656 | A1* | 5/2018 | Shehan | F02D 9/02 |
| 2019/0345905 | A1* | 11/2019 | Whittle | F02M 69/04 |
| 2020/0306703 | A1* | 10/2020 | Ryon | B01F 25/3143 |
| 2020/0309376 | A1* | 10/2020 | Prociw | F23D 11/38 |
| 2021/0332981 | A1* | 10/2021 | Prociw | F23R 3/14 |
| 2022/0003196 | A1* | 1/2022 | Farrell | F02D 9/1035 |

* cited by examiner

ELECTRONIC THROTTLE BODY WITH IMPROVED STRUCTURE

CROSS REFERENCE TO THE RELATED APPLICATIONS

This application is based upon and claims priority to Chinese Patent Application No. 202221061260.6, filed on May 5, 2022, the entire contents of which are incorporated herein by reference.

TECHNICAL FIELD

The present invention relates to the field of throttle body technologies of a vehicle, and specifically, to an electronic throttle body with an improved structure.

BACKGROUND

During operation of an engine of a fuel vehicle, an air inflow and fuel injection need to be controlled through a throttle body, so that air and fuel work through combustion after the air and the fuel are fully mixed. However, people who like vehicle modification pursue extreme combustion efficiency, so that how to further improve the combustion working efficiency of the engine is a direction pursued by products in this field.

At present, in products of this type of throttle body, a plurality of air inlet channels are generally provided to perform air intake and fuel injection separately, so that the fuel and the air are mixed more fully, thereby improving the combustion efficiency. However, butterfly valves controlling the air inflow of each air inlet channel are of a pull-wire structure, namely, rotating shafts driving the butterfly valves to rotate are linked through a connecting rod, and a wire associated with an accelerator pedal controls the butterfly valves to rotate to adjust opening angles of the butterfly valves. However, according to an aspect, accurate synchronization between opening angles of the butterfly valves of the pull-wire throttle body and injectors controlling fuel injection cannot be implemented. That is, a controller needs to output a signal to control a fuel injection quantity after a to-be-detected butterfly valve opening angle signal is transmitted to the controller, which leads to a signal delay. As a result, the air inflow and the fuel injection quantity cannot be accurately matched, reducing the combustion efficiency of the engine. According to a second aspect, when an existing engine provided with a pull-wire throttle body is idle, the butterfly valves are always in a closed state, the air inflow of the engine is controlled by an air intake value of an air bypass channel, and an opening or closing degree of the air intake value is controlled by a stepping motor. According to this method, the structure of the throttle body is relatively complex, and the stepping motor has relatively low control accuracy and a low response speed. As a result, the idling stability of the engine is relatively poor. According to a third aspect, the engine provided with a pull-wire throttle body may encounter serious shift shock since the engine cannot accurately match with an automatic transmission.

According to another aspect, after the fuel is sprayed from the injectors, the fuel needs to be atomized to be fully combined with the air, so as to improve the combustion efficiency. The atomization of the fuel is implemented through a fuel atomizing ring, and an existing fuel atomizing ring basically is to provide atomizing holes whose radial directions face toward an inner side on a wall uniformly. During operation of the fuel atomizing ring of this structure, when the fuel is sprayed to the middle from the atomizing holes, drops are formed on an inner wall of the fuel atomizing ring, which leads to inadequate combustion since the drops of the fuel cannot be fully mixed with the air. In addition, the fuel leaving the atomizing holes may be sputtered to a filter above the throttle body after opposite spraying, which pollutes the throttle body and reduce a filtering effect of the filter.

SUMMARY

The present invention provides an electronic throttle body with an improved structure, to improve the working efficiency of an engine.

To achieve the foregoing objective, the present invention adopts the following technical solutions:

An electronic throttle body with an improved structure is provided, including a throttle body, where a plurality of vertically through airflow channels are provided on the throttle body, and a butterfly valve controlling a vent flow and a fuel atomizing ring configured to atomize fuel are arranged in each airflow channel; and centers of one or more butterfly valves are connected in series through rotating shafts to implement linked flipping, the rotating shafts are arranged parallel to each other, a drive gear is fixedly mounted to one end of each rotating shaft extending out of the throttle body coaxially, and the rotating shafts rotate synchronously through a servo driving apparatus.

In an exemplary solution, a throttle position sensor (TPS) sensor configured to detect an opening angle of the butterfly valve is arranged on an other end of each rotating shaft.

In an exemplary solution, four airflow channels whose centers are distributed in a shape of a square are provided on the throttle body, and every two butterfly valves implement linked flipping through one rotating shaft.

In an exemplary solution, the fuel atomizing ring includes a cylindrical body, a fuel groove for guiding fuel is provided on an outer wall of the body, an inner wall of the body radially extends to form a plurality of separating plates, a fuel line in communication with the fuel groove is provided in the separating plate, and several atomizing holes in communication with the fuel line are uniformly distributed on a bottom edge of the separating plate. Further, the fuel groove is annularly distributed surrounding the outer wall of the body to communicate outer ends of the fuel lines, the separating plates are intersected in a cross shape, and inner ends of the fuel lines are in communication with each other.

In an exemplary solution, the fuel atomizing ring includes a cylindrical body, a concentric fuel distribution ring is arranged at a center of the body, a connecting rod exists between the fuel distribution ring and the body, a fuel line guiding fuel from an outer wall of the body into the fuel distribution ring is provided in the connecting rod, a fuel guide groove provided in a circumferential direction and in communication with the fuel line of the connecting rod is provided inside the fuel distribution ring, atomizing holes whose openings face downward and uniformly distributed on a bottom surface of the fuel distribution ring are further provided on the fuel distribution ring, and top ends of the atomizing holes are in communication with the fuel guide groove. Further, the connecting rod includes two groups of connecting rods symmetrically arranged on two sides of the fuel distribution ring.

Beneficial effects of the present invention are as follows:

1. Two rotating shafts are driven to rotate synchronously through a servo driving apparatus, according to an aspect, a rotating angle of each butterfly valve can be accurately controlled, so that the air inflow can be accurately controlled. In addition, the servo driving apparatus and electronic injectors respond synchronously, thereby achieving an optimal mixture state of an air flow and a fuel quantity and improving the combustion efficiency of the fuel in the engine. According to a second aspect, when the engine is idle, the butterfly valves may be directly driven through the servo driving apparatus to accurately control the air inflow of the engine. Compared with the related art, the air bypass channel, the air intake value controlling the vent flow, and the stepping motor do not need to be provided in the throttle body, which greatly simplifies the structure of the throttle body. In addition, an operating frequency of a servo motor is up to about 5K Hz to 10K Hz, which has high control precision and a high response speed, so that the idling stability of the engine can be greatly improved. According to a third aspect, an opening angle of the butterfly valve is controlled through the servo driving apparatus, and a spark advance angle is reduced under control of an engine control unit (ECU), so that the engine can perfectly match with a shift operation of the automatic transmission, thereby greatly reducing the shift shock and improving the driving comfort. 2. Openings of the atomizing holes are provided in a manner of facing downward, so that the fuel is sprayed directly downward, the filter may not be polluted due to sputtering, and the fuel may not be sprayed onto the inner wall of the fuel atomizing ring to form deposited liquid, which ensures that the fuel can be fully combined with the air after being sprayed out, thereby further improving the combustion efficiency of the fuel.

BRIEF DESCRIPTION OF THE DRAWINGS

The present invention is further described below in detail with reference to the accompanying drawings and specific embodiments.

DETAILED DESCRIPTION OF THE EMBODIMENTS

The present invention is further described below with reference to the accompanying drawings.

Figure 1:
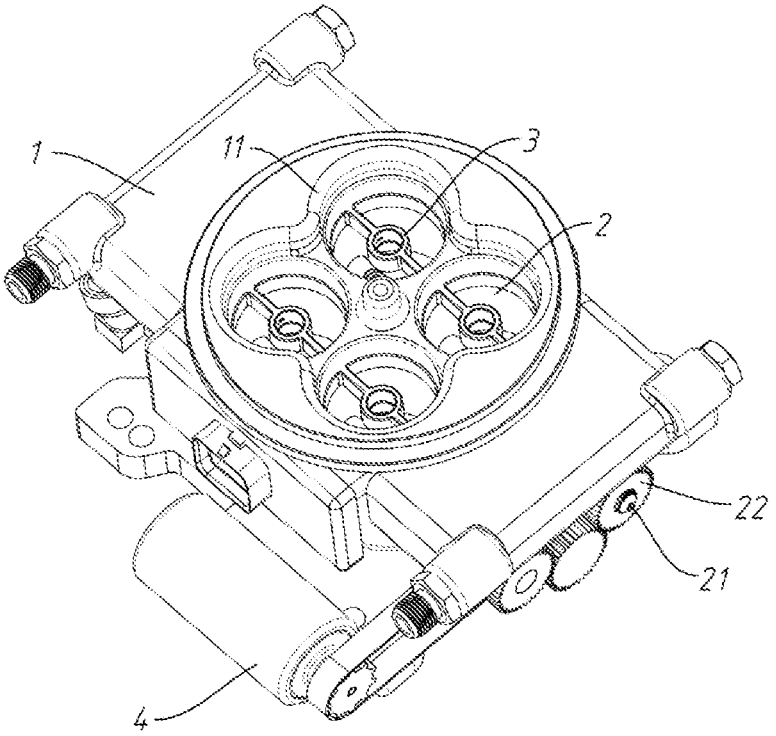
FIG. 1 is a schematic diagram of an overall structure of a throttle body according to an embodiment.
Figure 2:
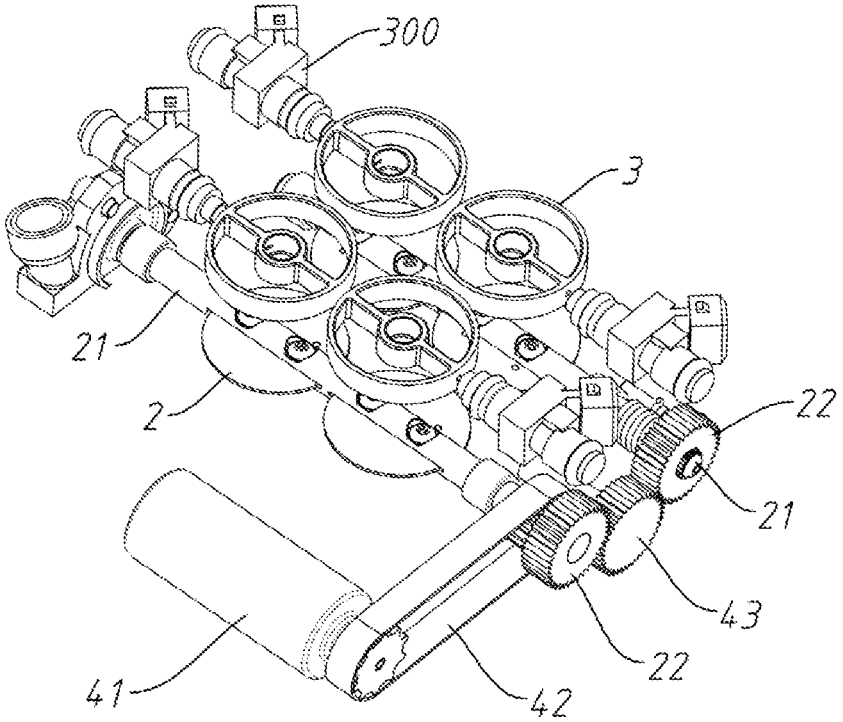
FIG. 2 is a schematic diagram of an internal structure of a throttle body according to an embodiment.

Referring to FIG. 1 and FIG. 2, an electronic throttle body with an improved structure is provided, including a throttle body 1, where four vertically through airflow channels 11 whose centers are distributed in a shape of a square are provided on the throttle body 1, a butterfly valve 2 controlling a vent flow and a fuel atomizing ring 3 configured to atomize fuel are arranged in each airflow channel 11, and the fuel atomizing ring 3 may be arranged above or below the butterfly valve 2. Centers of every two butterfly valves 2 are connected in series through a rotating shaft 21 to implement linked flipping, a drive gear 22 is fixedly mounted to one end of each rotating shaft 21 extending out of the throttle body 1 coaxially, synchronous rotation of two rotating shafts 21 is implemented through a servo driving apparatus 4, and a throttle position sensor (TPS) sensor configured to detect an opening angle of the butterfly valve 2 is arranged on an other end of each rotating shaft 21. The servo driving apparatus 4 includes a servo motor 41, a toothed belt 42 for driving the servo motor 41 and one drive gear 22, and a connection gear 43 engaged between two groups of drive gears 22. Two rotating shafts 21 are driven to rotate synchronously through the servo driving apparatus 4, according to an aspect, a rotating angle of each butterfly valve 2 can be accurately controlled, so that the air inflow of the engine can be accurately controlled. In addition, the servo driving apparatus 4 and electronic injectors 300 respond synchronously, thereby achieving an optimal mixture state of an air flow and a fuel quantity and improving the combustion efficiency of fuel in the engine. According to a second aspect, when the engine is idle, the butterfly valves 2 may be directly driven through the servo driving apparatus 4 to accurately control the air inflow of the engine. Compared with the related art, an air bypass channel, an air intake value controlling a vent flow, and a stepping motor do not need to be provided in the throttle body, which greatly simplifies the structure of the throttle body. In addition, an operating frequency of the servo motor 41 is up to about 5K Hz to 10K Hz, which has high control precision and a high response speed, so that the idling stability of the engine can be greatly improved. According to a third aspect, an opening angle of the butterfly valve 2 is controlled through the servo driving apparatus 4, and a spark advance angle is reduced under control of an engine control unit (ECU), so that the engine can perfectly match with a shift operation of an automatic transmission, thereby greatly reducing shift shock and improving the driving comfort.

Figure 3:
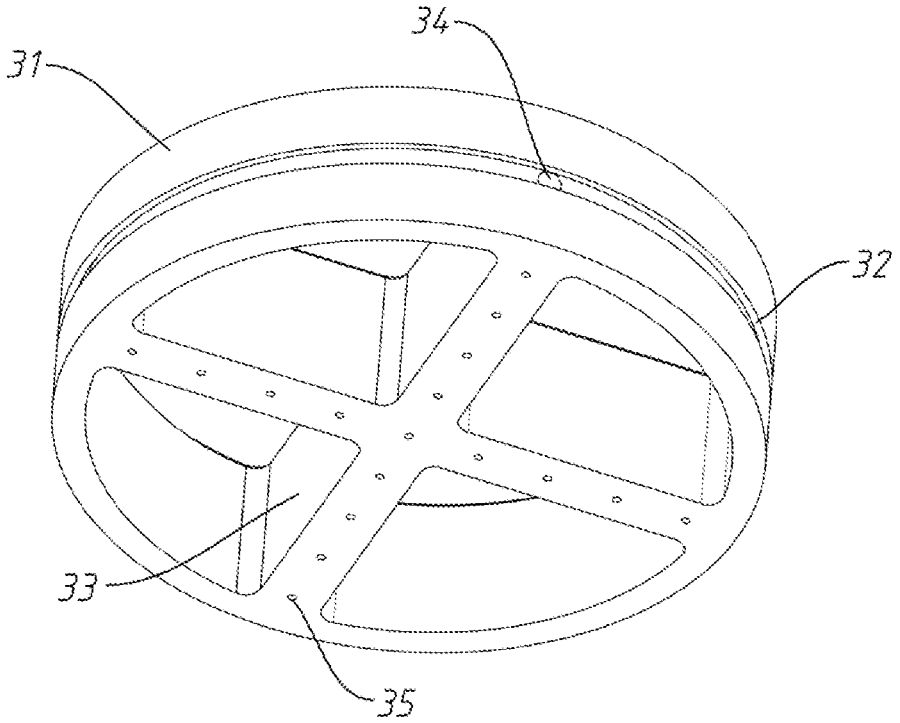
FIG. 3 is a schematic diagram of a first implementation structure of a fuel atomizing ring.
Figure 4:
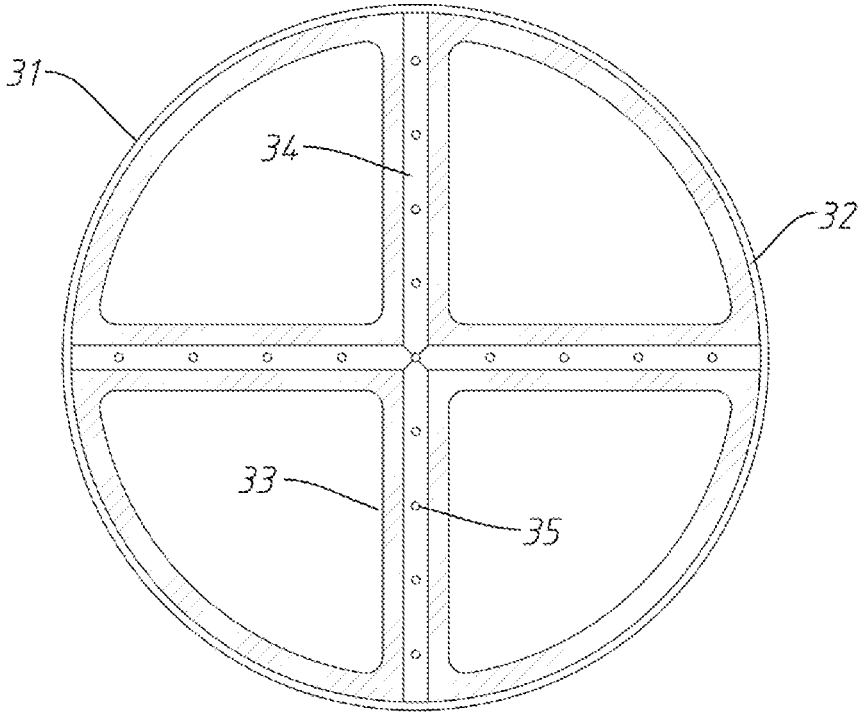
FIG. 4 is a longitudinal schematic cross-sectional structural view of the fuel atomizing ring in FIG. 3 along a center of separating plates.

Referring to FIG. 3 and FIG. 4, the fuel atomizing ring 3 includes a cylindrical body 31, a fuel groove 32 for guiding fuel is provided on an outer wall of the body 31, an inner wall of the body 31 radially extends to form a plurality of separating plates 33, a fuel line 34 in communication with the fuel groove 32 is provided in the separating plate 33, and several atomizing holes 35 in communication with the fuel line 34 are uniformly distributed on a bottom edge of the separating plate 33. Further, the fuel groove 32 is annularly distributed surrounding the outer wall of the body 31 to communicate outer ends of the fuel lines 34, the separating plates 33 are intersected in a cross shape, and inner ends of the fuel lines 34 are in communication with each other. Openings of the atomizing holes 35 are provided on a bottom surface of each separating plate 33, so that the fuel is sprayed directly downward, the filter may not be polluted due to sputtering, and the fuel may not be sprayed onto the inner wall of the fuel atomizing ring 3 to form deposited liquid. Meanwhile, drops may not be generated on the inner wall of the fuel atomizing ring 3 located on the same side with the atomizing holes 35 due to a negative pressure in the airflow channel 11. In addition, compared with an existing situation that the fuel is gathered in a local region after being sprayed out, the fuel sprayed out from the atomizing holes 35 are uniformly distributed in an internal region of the fuel atomizing ring 3, which ensures that the fuel can be fully combined with the air after being sprayed out, thereby further improving the combustion efficiency of the fuel. The annularly distributed fuel groove 32 and the inner ends of the fuel lines 34 are in communication with each other, so that the fuel can reach the atomizing holes 35 and be sprayed out quickly. In addition, due to the separating plates 33 intersected in a cross shape, the atomizing holes 35 are uniformly distributed and do not block an airflow in the airflow channel 11.

Figure 5:
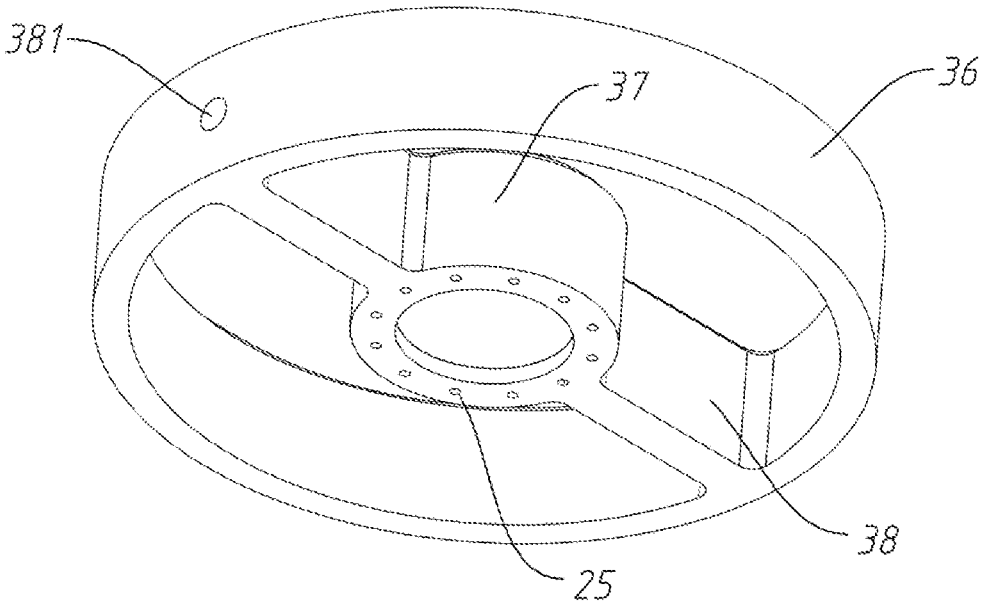
FIG. 5 is a schematic diagram of a second implementation structure of a fuel atomizing ring.
Figure 6:
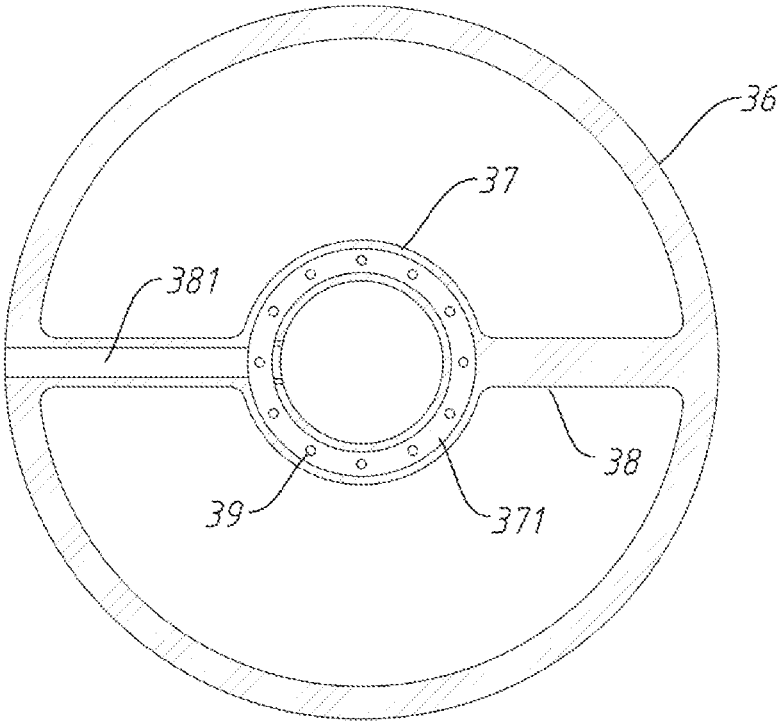
FIG. 6 is a transverse schematic cross-sectional structural view of the fuel atomizing ring in FIG. 5.

Referring to a fuel atomizing ring 3 of another implementation structure shown in FIG. 5 and FIG. 6, the fuel atomizing ring 3 includes a cylindrical body 36, a concentric fuel distribution ring 37 is arranged at a center of the body 36, a connecting rod 38 exists between the fuel distribution ring 37 and the body 36, a fuel line 381 guiding fuel from an outer wall of the body 36 into the fuel distribution ring 37 is provided in the connecting rod 38, a fuel guide groove 371 provided in a circumferential direction and in communication with the fuel line 381 of the connecting rod 38 is provided inside the fuel distribution ring 37, atomizing holes 39 whose openings face downward and uniformly distributed on a bottom surface of the fuel distribution ring 37 are further provided on the fuel distribution ring 37, and top ends of the atomizing holes 39 are in communication with the fuel guide groove 371. Further, the connecting rod 38 includes two groups of connecting rods symmetrically arranged on two sides of the fuel distribution ring 37. When the openings of the atomizing holes 39 are provided on the bottom surface of the fuel distribution ring 37, the fuel is sprayed directly downward, the filter may not be polluted due to sputtering, and the fuel may not be sprayed onto an inner wall of the fuel atomizing ring 3 to form deposited liquid, which ensures that the fuel can be fully combined with the air after being sprayed out, thereby further improving the combustion efficiency of the fuel. In addition, the fuel distribution ring 37 is arranged concentrically. Because a diameter of the fuel distribution ring 37 is relatively small, when air in the airflow channel 11 of the throttle body flows, according to the Bernoulli's principle, a flow rate of air flowing through the fuel distribution ring 37 is higher, so that the sprayed fuel can enter the inside of the engine for combustion timelier, thereby improving the combustion efficiency.

The above description constitute no limitation to the technical scope of the present invention, and any change, equivalent variation, or modification made to the foregoing embodiments according to the technical essence of the present invention still falls within the scope of the technical solutions of the present invention.

What is claimed is:

1. An electronic throttle body with an improved structure, comprising a throttle body, wherein a plurality of vertically through airflow channels are provided on the throttle body, and a butterfly valve controlling a vent flow and fuel atomizing ring configured to atomize fuel are arranged in each airflow channel; and centers of one or more butterfly valves are connected in series through rotating shafts to implement linked flipping, the rotating shafts are arranged parallel to each other, a drive gear is fixedly mounted to one end of each rotating shaft extending out of the throttle body coaxially, and the rotating shafts rotate synchronously through a servo driving apparatus, wherein a throttle position sensor (TPS) sensor configured to detect an opening angle of the butterfly valve is arranged on an other end of each rotating shaft.

2. The electronic throttle body with an improved structure according to claim 1, wherein four airflow channels whose centers are distributed in a shape of a square are provided on the throttle body, and every two butterfly valves implement linked flipping through one rotating shaft.

3. The electronic throttle body with an improved structure according to claim 2, wherein the fuel atomizing ring comprises a cylindrical body, a fuel groove for guiding fuel is provided on an outer wall of the body, an inner wall of the body radially extends to form a plurality of separating plates, a fuel line in communication with the fuel groove is provided in the separating plate, and several atomizing holes in communication with the fuel line are uniformly distributed on a bottom edge of the separating plate.

4. The electronic throttle body with an improved structure according to claim 3, wherein the fuel groove is annularly distributed surrounding the outer wall of the body to communicate outer ends of the fuel lines, the separating plates are intersected in a cross shape, and inner ends of the fuel lines are in communication with each other.

5. The electronic throttle body with an improved structure according to claim 2, wherein the fuel atomizing ring comprises a cylindrical body, a concentric fuel distribution ring is arranged at a center of the body, a connecting rod exists between the fuel distribution ring and the body, a fuel line guiding fuel from an outer wall of the body into the fuel distribution ring is provided in the connecting rod, a fuel guide groove provided in a circumferential direction and in communication with the fuel line of the connecting rod is provided inside the fuel distribution ring, atomizing holes whose openings face downward and uniformly distributed on a bottom surface of the fuel distribution ring are further provided on the fuel distribution ring, and top ends of the atomizing holes are in communication with the fuel guide groove.

6. The electronic throttle body with an improved structure according to claim 5, wherein the connecting rod comprises two groups of connecting rods symmetrically arranged on two sides of the fuel distribution ring.

* * * * *